US007891989B2

(12) United States Patent
Yash

(10) Patent No.: US 7,891,989 B2
(45) Date of Patent: Feb. 22, 2011

(54) ELECTRICAL CONNECTOR AND ELECTRICAL CONNECTOR HOUSING

(75) Inventor: Michael Yash, Milford, MI (US)

(73) Assignee: J. S. T. Corporation, Farmington Hills, MI (US)

( * ) Notice: Subject to any disclaimer, the term of this patent is extended or adjusted under 35 U.S.C. 154(b) by 0 days.

(21) Appl. No.: 12/487,122

(22) Filed: Jun. 18, 2009

(65) Prior Publication Data

US 2010/0323562 A1 Dec. 23, 2010

(51) Int. Cl.
*H01R 12/00* (2006.01)

(52) U.S. Cl. ..... 439/79

(58) Field of Classification Search ..... 439/79, 439/567

See application file for complete search history.

(56) References Cited

U.S. PATENT DOCUMENTS

| | | | | |
|---|---|---|---|---|
| 4,533,203 | A | 8/1985 | Feldman et al. | |
| 4,708,415 | A * | 11/1987 | White | 439/633 |
| 4,914,062 | A | 4/1990 | Voltz | |
| 4,915,655 | A * | 4/1990 | Tanaka | 439/676 |
| 4,955,819 | A * | 9/1990 | Harting et al. | 439/79 |
| 6,102,735 | A | 8/2000 | Chen et al. | |
| 6,482,031 | B1 | 11/2002 | Chen et al. | |
| 6,863,545 | B2 * | 3/2005 | Peloza | 439/79 |
| 2002/0168893 | A1 | 11/2002 | Kasahara | |
| 2004/0106307 | A1 | 6/2004 | Okitsu | |
| 2004/0203281 | A1 | 10/2004 | Crane et al. | |
| 2005/0186854 | A1 | 8/2005 | Huang | |
| 2007/0218762 | A1 | 9/2007 | Liao et al. | |
| 2008/0153360 | A1 * | 6/2008 | Yuan et al. | 439/676 |
| 2008/0207058 | A1 | 8/2008 | Zhu et al. | |
| 2008/0318457 | A1 | 12/2008 | Li et al. | |

FOREIGN PATENT DOCUMENTS

EP 0 840 408 A2 5/1998

OTHER PUBLICATIONS

PCT/ISA/220, PCT/ISA/210, PCT/ISA/237, App. No. PCT/US2010/039261, Sep. 29, 2010 (14 pages).

* cited by examiner

*Primary Examiner*—Ross N Gushi
(74) *Attorney, Agent, or Firm*—Rader, Fishman & Grauer PLLC

(57) ABSTRACT

An electrical connector includes a terminal assembly, a housing body, a first rib member and a second rib member. The terminal assembly includes a terminal mounting block and at least one terminal mounted therein. The housing body surrounds the terminal assembly and is connected to the terminal mounting block. The housing body and the terminal mounting block define a cavity with the at least one terminal projecting into the cavity from the terminal mounting block. The housing body has a top wall, a bottom wall and a pair of side walls disposed apart from one another to interconnect the top and bottom walls. The first and second rib members are connected to respective ones of the pair of side walls and extend longitudinally. The first and second rib members are disposed between the top wall and the bottom wall. An electrical connector housing is also described.

29 Claims, 10 Drawing Sheets

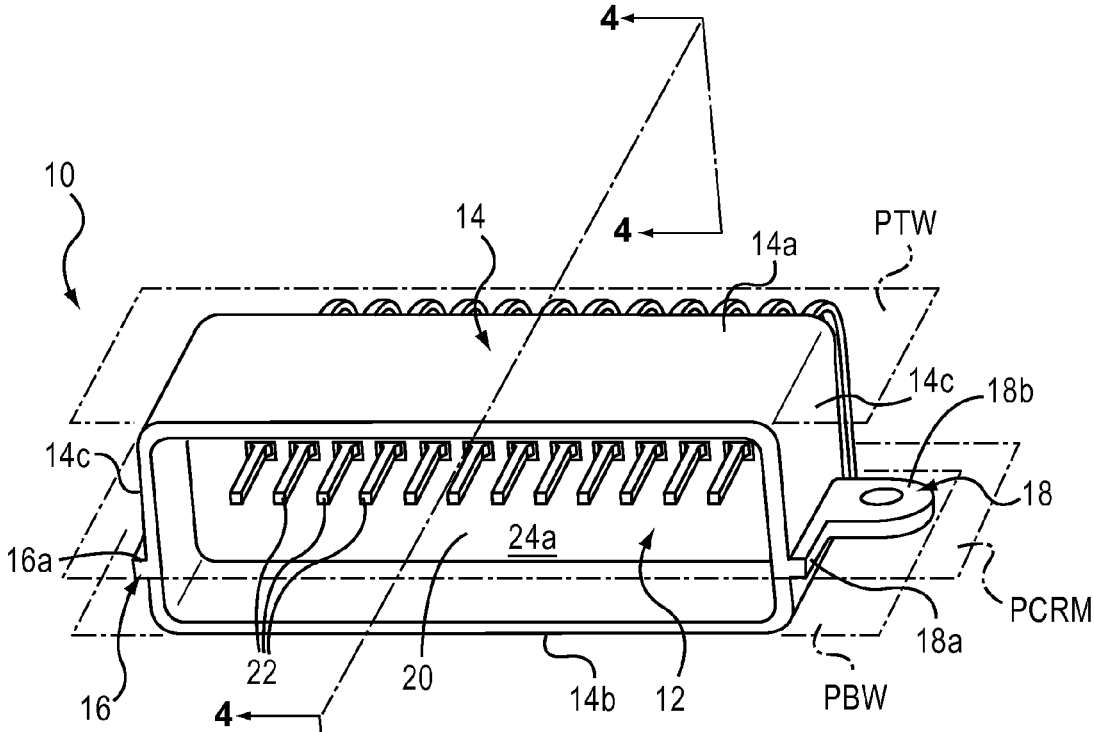
FIG.2
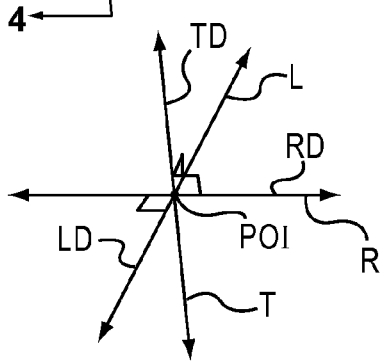

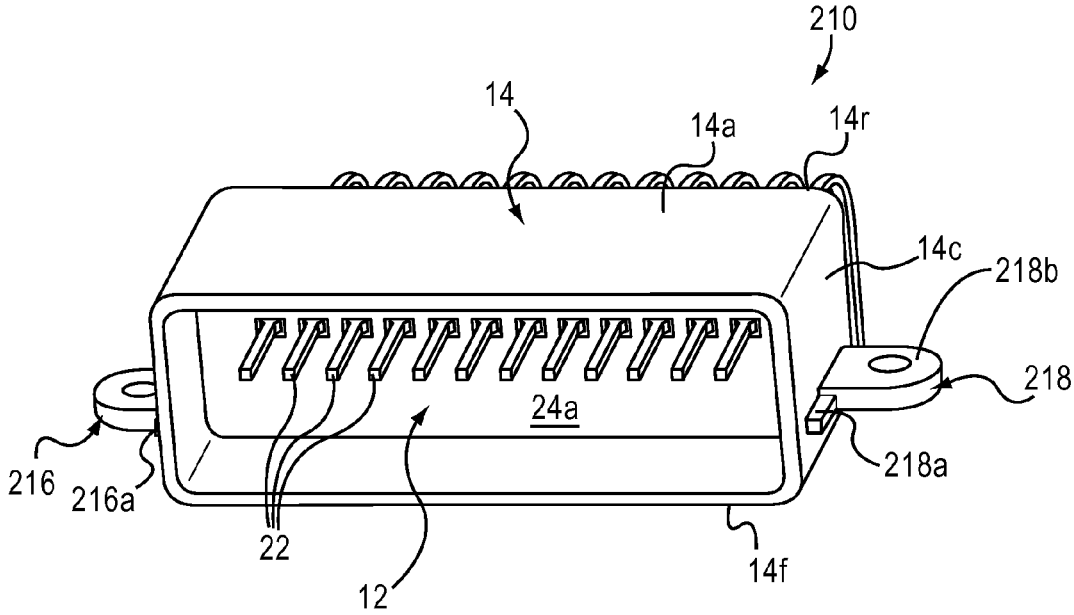
FIG.8
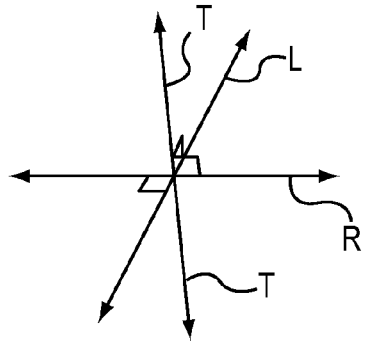

ELECTRICAL CONNECTOR AND ELECTRICAL CONNECTOR HOUSING

FIELD OF THE INVENTION

The present invention relates to an electrical connector and an electrical connector housing. More particularly, the present invention is directed to an electrical connector and an electrical connector housing, each of which having a first rib member and a second rib member connected thereto and extending to and between a front surface and a rear surface thereof.

BACKGROUND OF THE INVENTION

Many different types of electrical connectors are known in the art. One such electrical connector is described in U.S. Pat. No. 4,914,062 as a right-angled header for connecting a coaxial electrical cable to a printed circuit board. The right-angled header includes a molded thermoplastic encapsulating insulative body, one or more right-angled conductive metal electrical signal contact pins and a molded thermoplastic shroud. The molded thermoplastic encapsulating insulative body surrounds and holds the one or more right-angled conductive metal electrical signal contact pins in an evenly, ordered arrangement. Each of the signal contact pins is surrounded by the insulative body and a separate conductive metal shell. Each signal contact pin is affixed to each conductive metal shell. The molded thermoplastic shroud surrounds all faces of the right-angled header which do not have contact pins extending from their surface and bonds the right-angled header into a unitary whole.

A drawback associated with this type of right-angled header is that it is difficult to securely mount it to a support surface such as a printed circuit board. Also, this type of right-angled header does not facilitate mounting to the support surface in a low-profile manner. Furthermore, this right-angled header does not protect the support surface on which it is mounted.

It would be beneficial to provide an electrical connector that can be securely mounted to a support surface. It would also beneficial to provide an electrical connector that facilitates low-profile mounting to the support surface. Furthermore, it would also be beneficial to provide an electrical connector that protects the support surface on which it is mounted. The present invention provides these benefits.

SUMMARY OF THE INVENTION

An electrical connector of the present invention includes a terminal assembly, a housing body, a first rib member and a second rib member. The terminal assembly includes a terminal mounting block and at least one terminal mounted therein. The housing body surrounds the terminal assembly and is connected to the terminal mounting block. The housing body and the terminal mounting block that is connected thereto define a cavity with the at least one terminal projecting into the cavity from the terminal mounting block. The housing body has a top wall extending in the longitudinal direction and the lateral direction to define a top wall plane, a bottom wall extending in the longitudinal direction and the lateral direction to define a bottom wall plane extending parallel to the top wall plane and a pair of side walls extending in the longitudinal direction and the transverse direction. The pair of side walls are disposed apart from one another and interconnect the top and bottom walls to form a front surface and a rear surface opposite the front surface. The cavity extends in the longitudinal direction into the housing body from the front surface and towards the rear surface.

Respective ones of the first and second rib members are connected exteriorly of the housing body to respective ones of the pair of side walls and extend in the longitudinal direction. The first and second rib members are disposed between the top wall plane and the bottom wall plane.

An electrical connector housing of the present invention includes the housing body, the first rib member and the second rib member discussed above.

The present invention will be better appreciated in view of the detailed description of the exemplary embodiments of the present invention with reference to the accompanying drawings, in which:

BRIEF DESCRIPTION OF THE DRAWINGS

FIG. 2 is a perspective view the first exemplary embodiment of the electrical connector in FIG. 1 with the terminal assembly and the electrical housing body connected to each other.

FIG. 8 is a perspective view a second exemplary embodiment of an electrical connector of the present invention with the terminal assembly and the electrical housing body integrally connected to each other.

DETAILED DESCRIPTION OF THE EXEMPLARY EMBODIMENTS

Figure 1:
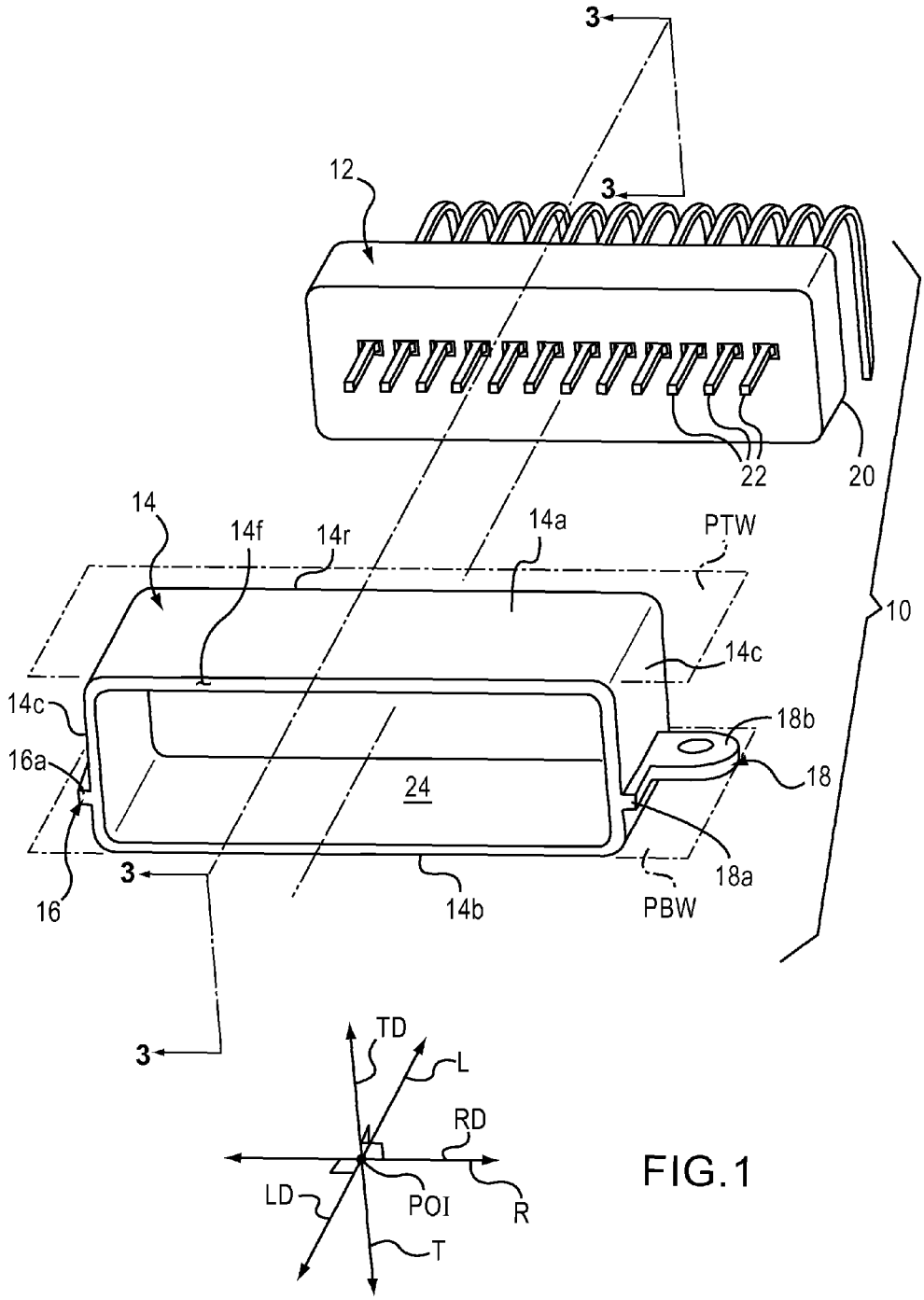
FIG. 1 is a perspective view a first exemplary embodiment of an electrical connector of the present invention with a terminal assembly and an electrical housing body spaced apart from one another.

Hereinafter, embodiments of the present invention will be described with reference to the attached drawings. The structural components common to the respective embodiments of the present invention will be represented by the same symbols and repeated description thereof will be omitted. Furthermore, one of ordinary skill in the art would appreciate that descriptive and orienting terms such as "top", "bottom", "front", "back" and the like are used herein for ease of understanding the invention only and should not be construed as limiting the invention. A skilled artisan may substitute non-descriptive and/or non-orienting terms such as "first", "second" and the like for the descriptive, orienting terms used herein.

A first exemplary embodiment of an electrical connector 10 is introduced in FIGS. 1-7. The electrical connector 10 includes a terminal assembly 12, a housing body 14, a first rib member 16 and a second rib member 18. The terminal assembly 12 has a terminal mounting block 20 and a plurality of electrical terminals 18. However, one of ordinary skill in the art would appreciate that the terminal mounting block 16 would have at least one terminal 18 mounted therein. Further, a skilled artisan would appreciate that at the terminal assembly 12 is illustrated by way of example only and not by way of limitation and can be any type of terminal assembly.

Figure 3:
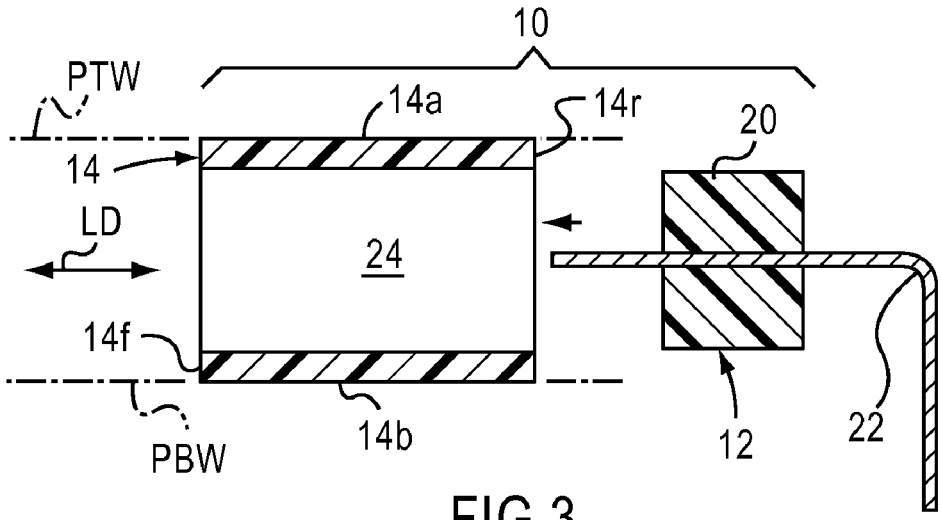
FIG. 3 is a cross-sectional view of the first embodiment of the electrical connector taken along line 3-3-3-3 in FIG. 1.

As best shown in FIGS. 1 and 2, the housing body extends along and about a longitudinal axis L that defines a longitudinal direction LD, a lateral axis R that defines a lateral direction RD and a transverse axis T that defines a transverse direction TD. Note that the longitudinal axis L, the lateral axis R and the transverse axis T perpendicularly intersect one another at a point of intersection POI to form a conventional Cartesian coordinate system. With reference to FIGS. 1-7, the housing body 14 has a top wall 14*a* that extends in the longitudinal direction LD and the lateral direction RD to define a top wall plane PTW, a bottom wall 14*b* that extends in the longitudinal direction LD and the lateral direction RD to define a bottom wall plane PBW that extends parallel to the top wall plane PTW and a pair of side walls 14*c* that extend in the longitudinal direction LD and the transverse direction TD. The pair of side walls 14*c* are disposed apart from one another and interconnect the top and bottom walls 14*a* and 14*b* respectively to form a front surface 14*f*, a rear surface 14*r* that is disposed opposite the front surface 14*f* and a passageway 24. As best shown in FIGS. 1 and 3, the passageway 24 extends in the longitudinal direction LD through the housing body 14 between the front surface 14*f* and the rear surface 14*r*.

Figure 4:
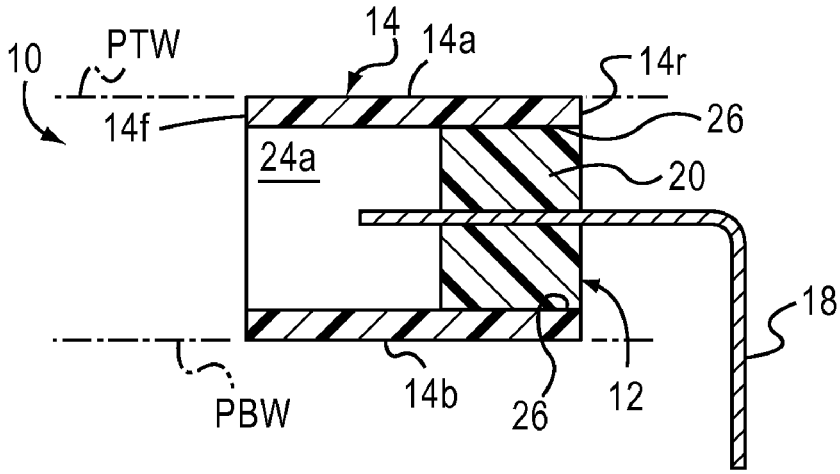
FIG. 4 is a cross-sectional view of the first embodiment of the electrical connector taken along line 4-4-4-4 in FIG. 2.

As shown sequentially in FIGS. 3 and 4, the terminal assembly 12 is inserted into the passageway 24 of the housing body 14. Now, the housing body 14 surrounds the terminal assembly 12. The housing body 14 and the terminal mounting block 20 are connected together, for example, by an adhesive 26. However, one of ordinary skill in the art would appreciate that the housing body 14 and the terminal mounting block 20 can be connected together in any conventional manner such as by mechanical fasteners or laser welding. The housing body 14 and the terminal mounting block 20 now being connected together define a cavity 24*a* as best shown in FIGS. 2 and 4. As best shown in FIG. 4, the plurality of terminals 22 project into the cavity 24*a* from the terminal mounting block 20.

Figure 5:
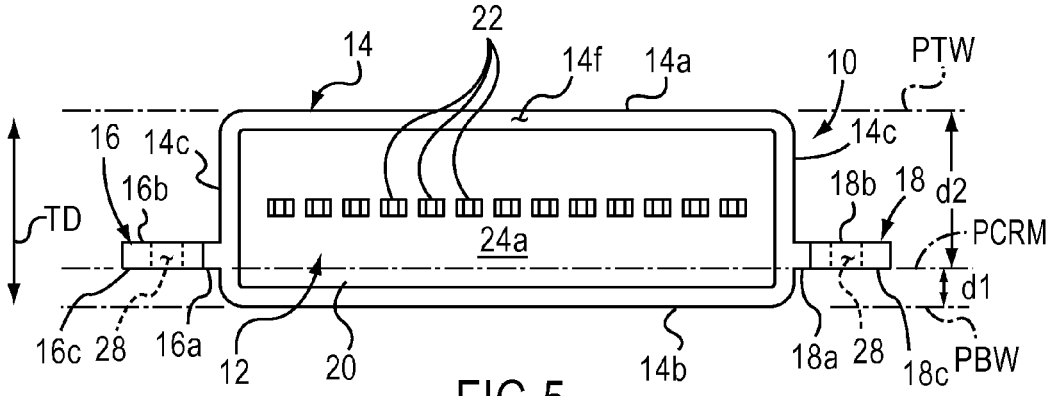
FIG. 5 is a front elevation view of the first embodiment of the electrical connector.

As best shown in FIGS. 1, 2, 5 and 6, respective ones of the first and second rib members 16 and 18 respectively are connected exteriorly of the housing body 14 to respective ones of the pair of side walls 14*c*. Generally, the first and second rib members 16 and 18 respectively extend in the longitudinal direction LD and are disposed between the top wall plane PTW and the bottom wall plane PBW as illustrated in FIGS. 1, 2 and 5.

Figure 6:
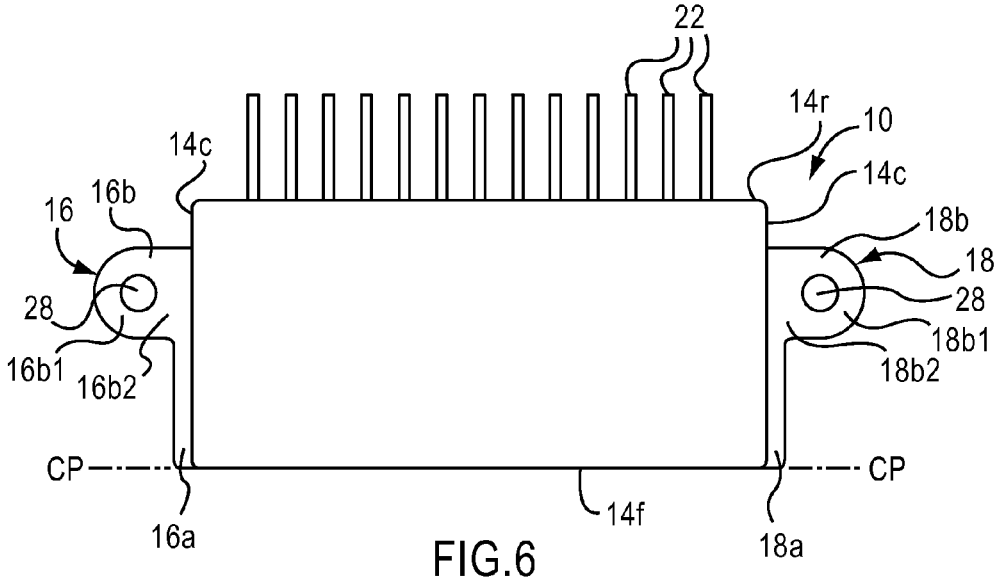
FIG. 6 is a top plan view of the first embodiment of the electrical connector.

As best shown in FIGS. 1, 2 and 6, the first rib member 16 includes a first rib element 16*a* and a first eyelet element 16*b* and the second rib member 18 includes a second rib element 18*a* and a second eyelet element 18*b*. The first rib element 16*a* and the first eyelet element 16*b* are integrally connected together and the second rib element 18*a* and the second eyelet element 18*b* are integrally connected together. Although not by way of limitation, both the first rib element 16*a* and the second rib element 18*a* are bars having a rectangular shape as viewed in front elevation as shown in FIG. 5.

With reference to FIG. 6, the first eyelet element 16*b* has a U-shaped first eyelet portion 16*b*1 and a box-shaped first eyelet portion 16*b*2 that is integrally connected to the U-shaped first eyelet portion 16*b*1. The second eyelet element 18*b* has a U-shaped second eyelet portion 18*b*1 and a box-shaped second eyelet portion 18*b*2 that is integrally connected to the U-shaped second eyelet portion 18*b*1. Respective ones of the box-shaped first and second eyelet portions 16*b*1 and 18*b*1 are connected to respective ones of the pair of side walls 14*c*.

Figure 7:
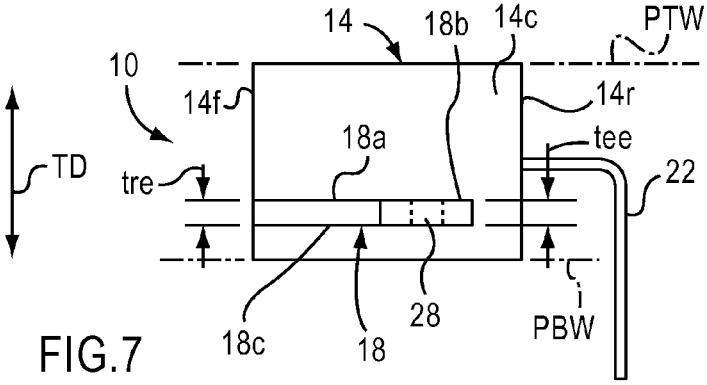
FIG. 7 is a right side elevation view of the first embodiment of the electrical connector.
Figure 9:
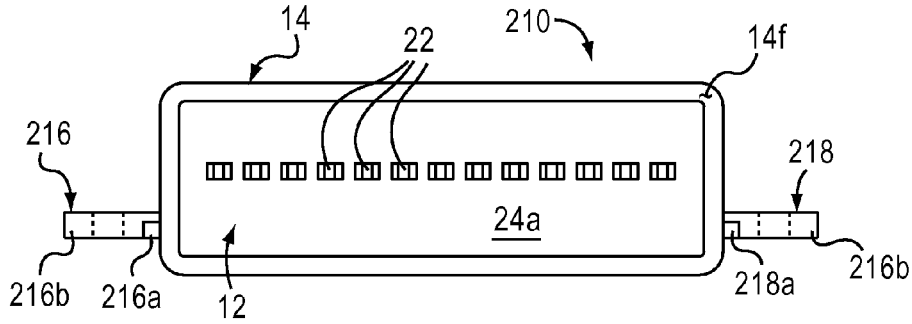
FIG. 9 is a front elevation view of the second embodiment of the electrical connector.

With reference to FIG. 7, by way of example, the second eyelet element 18*b* has an eyelet element thickness tee as viewed along the transverse direction TD and the second rib element 18*a* has a rib element thickness tre as viewed along the transverse direction TD. For the first exemplary embodiment of the electrical connector 10 of the present invention, the eyelet element thickness tee and the rib element thickness tre are the same. Further, a skilled artisan would appreciate that the first eyelet element 16*b* also has an eyelet element thickness which is the same as the second eyelet element thickness, i.e. tee, and, correspondingly, the first rib element 16*a* has a rib element thickness which is the same as the second rib element thickness, i.e, tre. Furthermore, for the first exemplary embodiment of the electrical connector 10 of the present invention, the eyelet element thickness tee and rib element thickness tre are equal to each other.

With reference to FIGS. 5-7, each one of the first and second eyelet elements 16*b* and 18*b* respectively has an eyelet hole 28. As shown in FIGS. 5 and 7, the eyelet holes 28 extend in the transverse direction TD through the respective ones of the first and second eyelet elements 16*b* and 18*b*.

Again, for the first exemplary embodiment of the electrical connector 10 of the present invention, each respective one of the first and second rib elements 16*a* and 18*a* commences at a commencement position CP as shown in FIG. 6 which is at the front surface 14*f*, extends towards the rear surface 14*r* and terminates at the respective first and second eyelet element 16*a* and 18*a*. As best shown in FIGS. 5 and 7, each one of the first and second rib members 16 and 18 respectively has a flat bottom rib member surface 16*c* and 18*c*. With reference to FIGS. 2 and 5, the flat bottom rib member surfaces 16*c* and 18*c* are disposed in a common rib member plane PCRM. The common rib member plane PCRM extends between and is parallel to the top wall plane PTW and the bottom wall plane PBW as illustrated in FIGS. 2 and 5. Furthermore, note that the common rib member plane PCRM is disposed closer to the bottom wall plane PBW relative, i.e., than it is, to the top wall plane PTW. In other words, the common rib member plane PCRM is disposed at a first distance d1 to the bottom wall plane PBW that is less than a second distance d2 from the common rib member plane PCRM to the top wall plane PTW as shown in FIG. 5.

A second exemplary embodiment of an electrical connector 210 of the present invention is introduced in FIGS. 8-13.

The second exemplary embodiment of the electrical connector 210 of the present invention of the present invention is similar to the first exemplary embodiment of the electrical connector 10 discussed above except as discussed below.

For the second exemplary embodiment of the electrical connector 210 of the present invention, it is noted that rather than having two separate components, i.e, the terminal assembly 12 and the housing body 14 connected together by an adhesive, as discussed above for the first embodiment, a skilled artisan would comprehend that the second exemplary embodiment of the electrical connector 210 can be one integral construction in that the terminal mounting block 20 and the housing body 14 are formed around the terminals 22 in a singe injection molding step. Thus, for the second exemplary embodiment of the electrical connector 210 of the present invention, the housing body 14 and the terminal assembly 12 are connected to each other as an integral construction.

Figure 10:
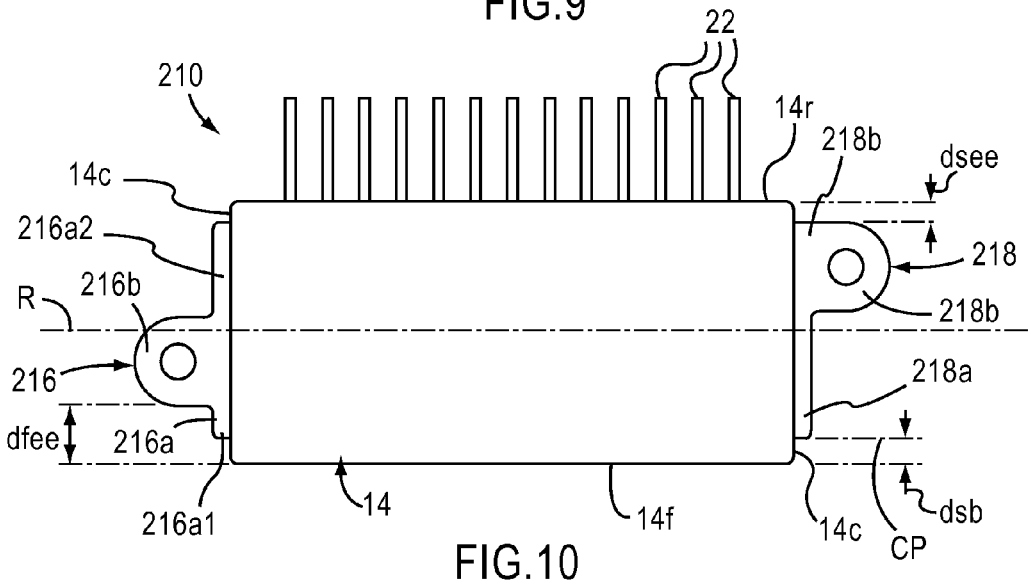
FIG. 10 is a top plan view of the second embodiment of the electrical connector.
Figure 11:
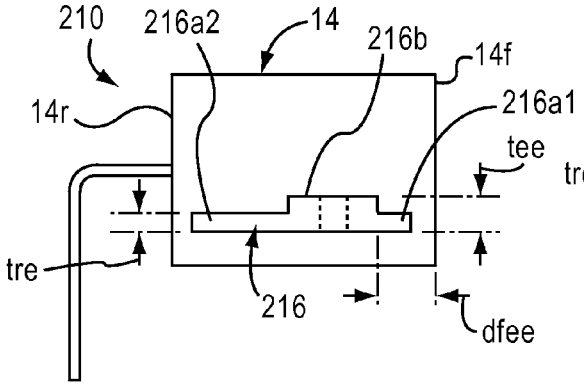
FIG. 11 is a left side elevation view of the second embodiment of the electrical connector.
Figure 12:
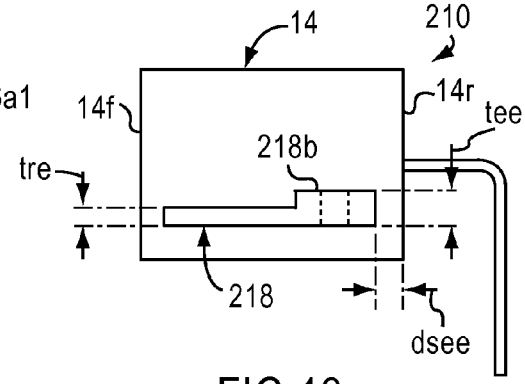
FIG. 12 is a right side elevation view of the second embodiment of the electrical connector.

As shown in FIGS. 8-12, a first rib member 216 and the second rib member 218 are different from one another. As best shown in FIGS. 11 and 12, the eyelet element thickness tee and rib element thickness tre are different from one another in that the eyelet element thickness tee is larger than the rib element thickness tre. Also, as shown in FIGS. 10-13, each one of a first and second rib element 216*a* and 218*a* respectfully commences at a commencement position CP (FIG. 10) that is set back a distance dsb from the front surface 14*f*. The first and second rib elements 216*a* and 218*a* respectfully thereafter extend towards the rear surface 14*r* and terminates at respective ones of first and second eyelet elements 216*b* and 218*b*.

Figure 13:
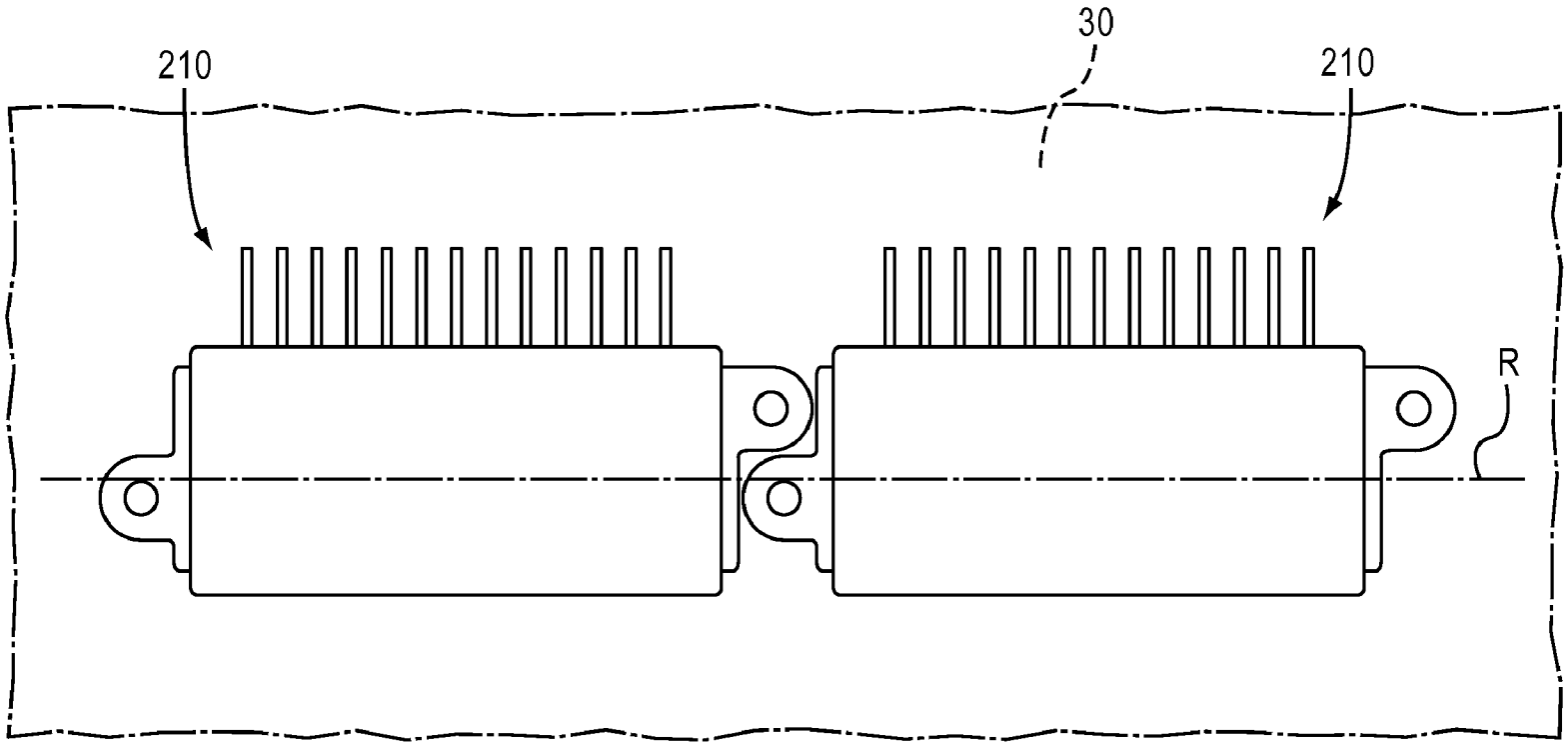
FIG. 13 is a top plan view of a pair of the electrical connectors illustrated in FIGS. 8-12 illustrated juxtaposed to one another on a support surface.

By way of example only and not by way of limitation, the second eyelet element 218*b* of the second rib member 218 is disposed adjacent to and set back from the rear surface at a distance dsee shown in FIGS. 10 and 12. In FIGS. 10 and 11, the first eyelet element 216*b* of the first rib member 216 is disposed adjacent to and set back from the front surface 14*f* a distance dfee. The second eyelet element 218*b* of the second rib member 218 is disposed closer to the rear surface 14*r* than the first eyelet element 216*b* and the first eyelet element 216*b* is disposed closer to the front surface 14*f* than the second eyelet element 218*b*. Thus, as shown in FIGS. 10 and 13, the first eyelet element 216*b* is disposed mostly on a front side of the centrally-disposed lateral axis R and the second eyelet element 218*b* is disposed on a rear side of the centrally-disposed lateral axis R. This offset arrangement of the first and second eyelet elements 216*b* and 218*b* respectively enables juxtaposed ones of two electrical connectors 210 of the present invention to be positioned closer to each other as shown in FIG. 13 when mounted to a support surface 30 compared to a generally symmetrical arrangement such as the first embodiment of the electrical connector 10 described above.

Also, as best shown in FIGS. 10 and 11, the first rib member 216 which is disposed adjacent to and set back from the front surface 14*f* has a first portion rib element 216*a*1 and a second portion rib element 216*a*2. Note that the eyelet element 216*b* is disposed between and integrally connected to the first portion rib element 216*a*1 and the second portion rib element 216*a*2. The first portion rib element 216*a*1 is disposed adjacent the front surface 14*f* and the second portion rib element 216*a*2 is disposed adjacent the rear surface 14*r*. Further, note that the first portion rib element 216*a*1 is shorter as shown in FIGS. 10 and 11 than the second portion rib element 216*a*2.

A third exemplary embodiment of an electrical connector 310 of the present invention is introduced in FIGS. 14-17. The third exemplary embodiment of the electrical connector 310 of the present invention is similar to the second exemplary embodiment of the electrical connector 210 of the present invention except as discussed below.

Figure 16:
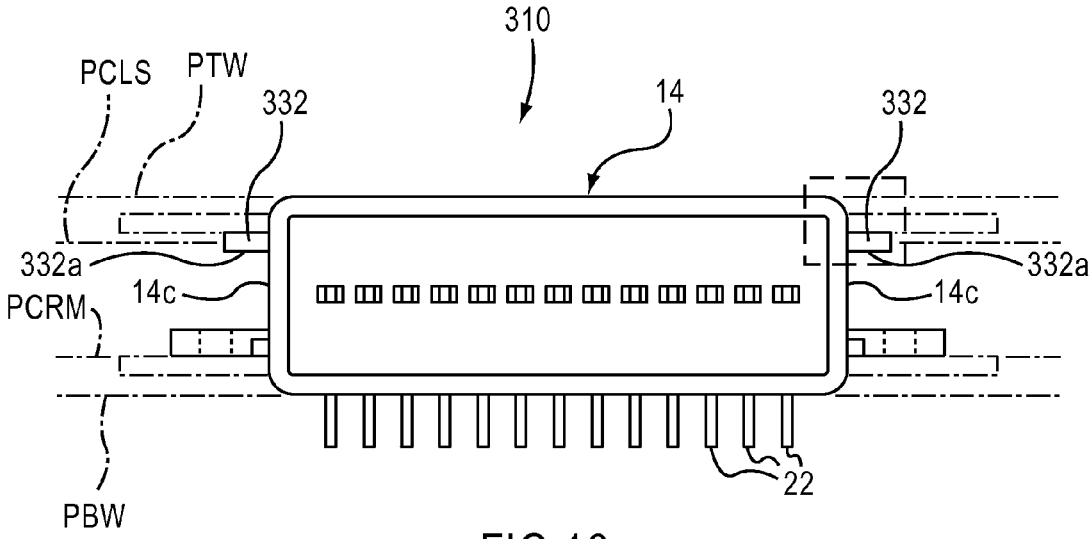
FIG. 16 is a front elevation view the third exemplary embodiment of the electrical connector similar received by the support surface with the lid disposed on the electrical connector.
Figure 17:
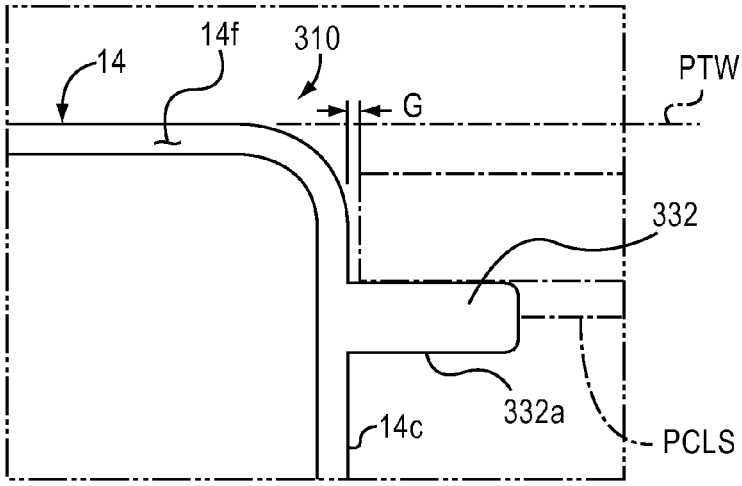
FIG. 17 is an enlarged front elevation view of a portion of the third exemplary embodiment of the electrical connector in FIG. 16.

The electrical connector 310 includes a pair of lid support members 332 as shown in FIGS. 14-17. The lid support members 332 are disposed exteriorly of the housing body 14. Specifically, respective ones of the pair of lid support members 332 are connected to respective ones of the pair of side walls 14*c*. Respective ones of the pair of lid support members 332 extend in the longitudinal direction LD and to project in the lateral direction RD away from the respective ones of the pair the side walls 14*c*. Furthermore, the respective ones of the pair of lid support members 332 extend from and between the front surface 14*f* and the rear surface 14*r*. As best shown in FIGS. 16 and 17, each one of the pair of lid support members has a flat bottom lid support member surface 332*a* that is disposed in a common lid support member plane PCLS. The common lid support member plane PCLS extends between and parallel to the top wall plane PTW and the bottom wall plane PBW. As best shown in FIG. 16, the common lid support member plane PCLS is disposed closer to the top wall plane PTW relative to the bottom wall plane PBW. Further, note that the common lid support member plane PCLS is disposed between and extends parallel to the common rib member plane PCRM and the top wall plane PTW as reflected in FIG. 16.

Figure 14:
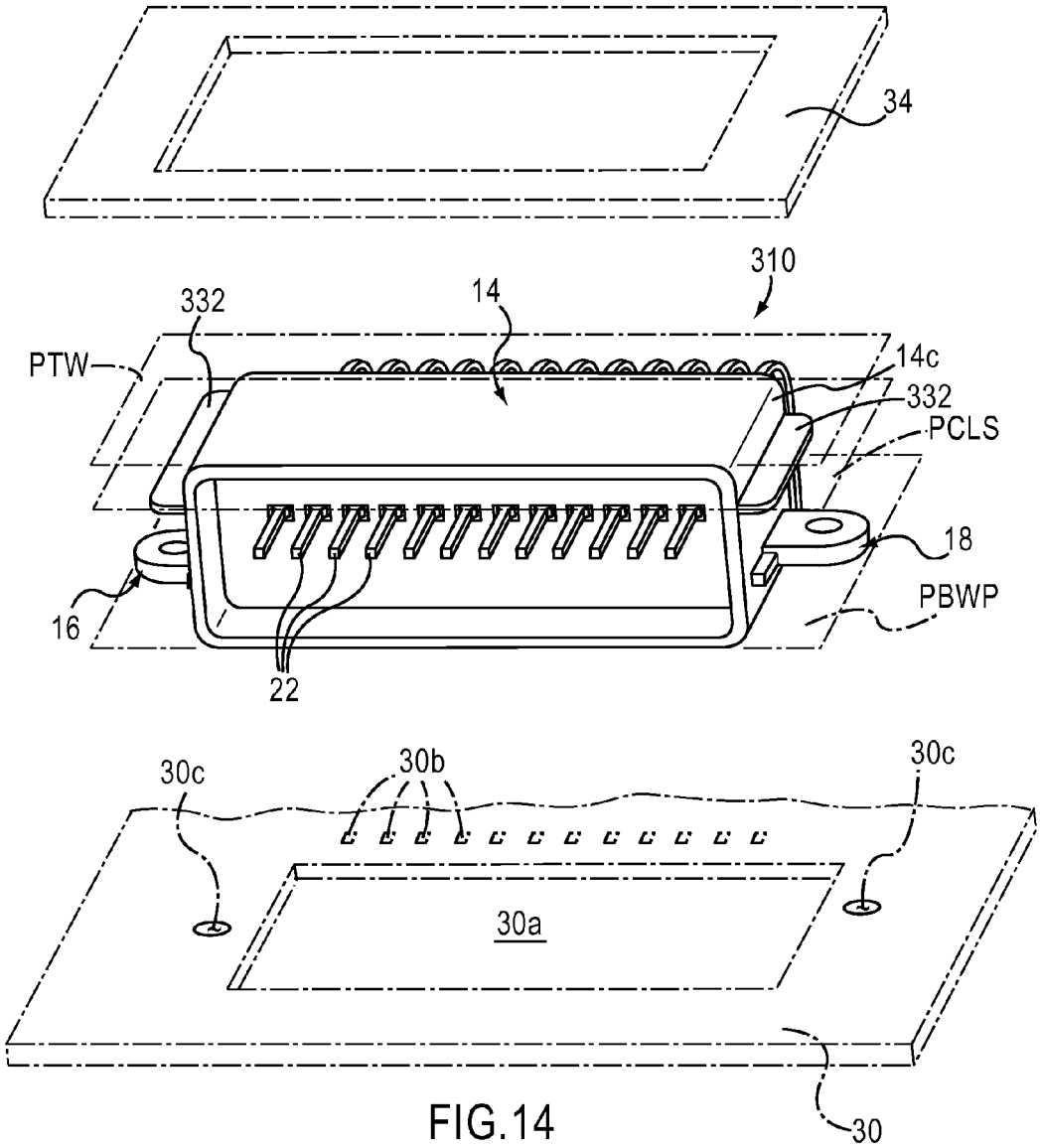
FIG. 14 is a perspective view a third exemplary embodiment of an electrical connector of the present invention disposed between a support surface and a lid.
Figure 15:
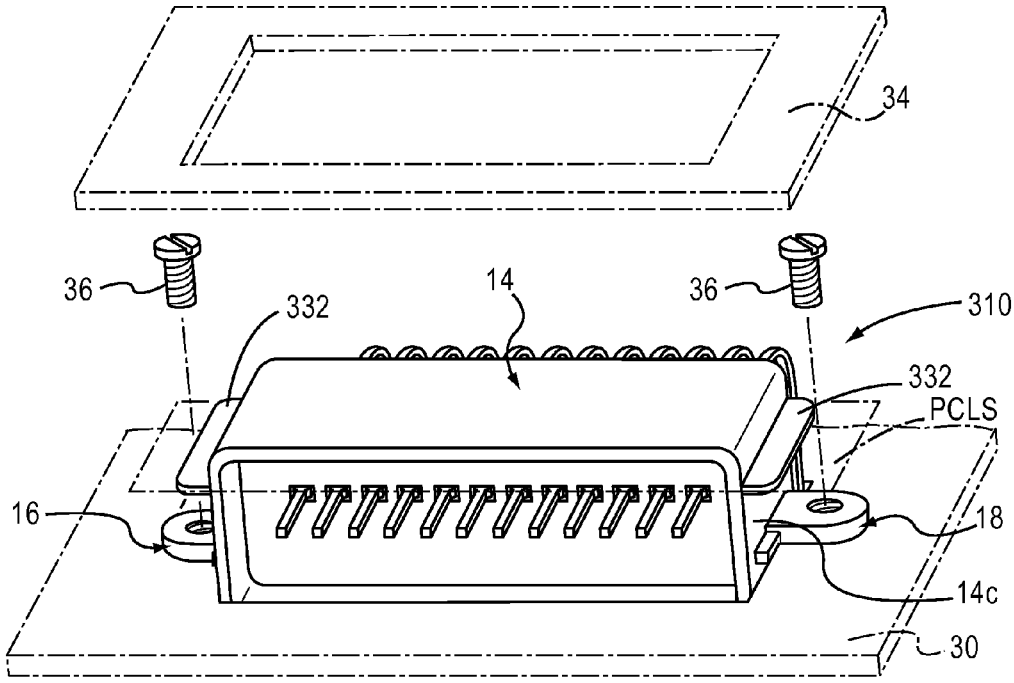
FIG. 15 is a perspective view the third exemplary embodiment of the electrical connector received by the support surface with the lid disposed above the electrical connector.
Figure 15:
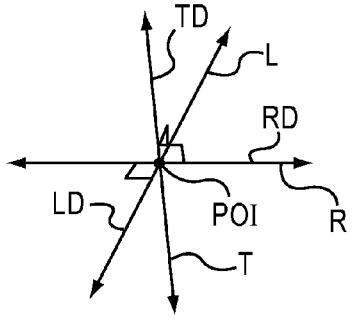

A shown in FIG. 14, the electrical connector 310 is disposed in a space typed on a part matter between the support surface 30 and a lid 34. The support surface 30 which can be a printed circuit board has a hole 30*a* and a plurality of terminal receiving holes 30*b* formed therethrough. The hole 30*a* is sized to receive the electrical connector 310 and the plurality of terminal receiving holes 30*b* are sized to receive respective ones of the plurality of terminals 22 which project outwardly and away from the electrical connector 310. And FIG. 15, the electrical connector 310 is received in the hole 30*a* of the support surface 30 and the first and second rib members 16 and 18 rest on the support surface 30. With the first and second rib members 16 and 18 resting on the support surface 30, the electrical connector 310 is stabilized thereon thereby preventing the electrical connector 310 from tipping or rotating before fasteners 36 fasten it to the support surface 30 through fastener holes 30*c*. Also, with the electrical connector 310 disposed in the hole 30*a*, minimum packaging space is required because the electrical connector 310 projects from the bottom of the support surface 30.

In FIG. 16, the lid 34 is positioned on the electrical connector 310 and rests upon the pair of the lid support members 332. Note in FIG. 17, a small gap G exists between the lid 34 and the appropriate side wall 14*c*. In the event that a small amount of a liquid such as water accidentally contacts the lid 34 and the electrical connector 310, it is theorized that the gap G through capillary action will prevent the liquid from seeping below the lid support members 332.

One of ordinary skill in the art would appreciate that the electrical connector or the electrical connector housing can be securely mounted to a support surface such as a printed circuit board by virtue of the first and second rib members. Further, a skilled artisan would appreciate that the electrical connector as well as the electrical connector housing facilitate low-profile mounting to the support surface. Also, it is appreciated that the electrical connector and the electrical connector housing protects the support surface when the same are mounted thereon.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector housing, comprising:

a housing body extending along and about a longitudinal axis defining a longitudinal direction, a lateral axis defining a lateral direction and a transverse axis defining a transverse direction, the longitudinal axis, the lateral axis and the transverse axis perpendicularly intersecting one another at a point of intersection to form a Cartesian coordinate system, the housing body having a top wall extending in the longitudinal direction and the lateral direction to define a top wall plane, a bottom wall extending in the longitudinal direction and the lateral direction to define a bottom wall plane extending parallel to the top wall plane and a pair of side walls extending in the longitudinal direction and the transverse direction, disposed apart from one another and interconnecting the top and bottom walls to form a front surface, a rear surface opposite the front surface and a passageway extending in the longitudinal direction through the housing body between the front surface and the rear surface; and a first rib member and a second rib member, respective ones of the first and second rib members being connected exteriorly of the housing body to respective ones of the pair of side walls and extending in the longitudinal direction, the first and second rib members being disposed between the top wall plane and the bottom wall plane, wherein each one of the first and second rib members includes a rib element and an eyelet element integrally connected to the rib element, wherein each rib element commences at a commencement position either at the front surface or set back from the front surface, extends towards the rear surface and terminates at the eyelet element, wherein the eyelet element of one of the first and second rib members is disposed adjacent to and set back from the rear surface and wherein the eyelet element of a remaining one of the first and second rib members is disposed adjacent to and set back from the front surface.

2. An electrical connector housing according to claim 1, wherein each one of the rib elements is a bar having a rectangular shape as viewed in front elevation.

3. An electrical connector housing according to claim 1, wherein each one of the eyelet elements has a U-shaped eyelet portion and a box-shaped eyelet portion integrally connected to the U-shaped eyelet portion, respective ones of the box-shaped eyelet portions being connected to respective ones of the pair of side walls.

4. An electrical connector housing according to claim 3, wherein each one of the eyelet elements has an eyelet element thickness as viewed along the transverse direction and each one of the rib elements has a rib element thickness as viewed along the transverse direction.

5. An electrical connector housing according to claim 4, wherein the eyelet element thickness and rib element thickness are either equal to each other or the eyelet element thickness is larger than the rib element thickness.

6. An electrical connector housing according to claim 1, wherein each one of the eyelet elements has an eyelet hole extending in the transverse direction therethrough.

7. An electrical connector housing according to claim 1, wherein the remaining one of the first and second rib members disposed adjacent to and set back from the front surface has a first portion rib element and a second portion rib element with the eyelet element disposed between and integrally connected to the first portion rib element and the second portion rib element.

8. An electrical connector housing according to claim 7, wherein the first portion rib element is disposed adjacent the front surface and the second portion rib element is disposed adjacent the rear surface, the first portion rib element being shorter than the second portion rib element.

9. An electrical connector housing according to claim 1, wherein each one of the first and second rib members has a flat bottom rib member surface disposed in a common rib member plane, the common rib member plane extending between and parallel to the top wall plane and the bottom wall plane.

10. An electrical connector housing according to claim 9, wherein the common rib member plane is disposed closer to the bottom wall plane relative to the top wall plane.

11. An electrical connector housing according to claim 1, further comprising a pair of lid support members disposed exteriorly of the housing body, respective ones of the pair of lid support members connected to respective ones of the pair of side walls in a manner to extend in the longitudinal direction along and to project in the lateral direction away from respective ones of the pair the side walls.

12. An electrical connector housing according to claim 11, wherein respective ones of the pair of lid support members extend from and between the front surface and the rear surface.

13. An electrical connector housing according to claim 1, wherein each one of the pair of lid support members has a flat bottom lid support member surface disposed in a common lid support member plane, the common lid support member plane extending between and parallel to the top wall plane and the bottom wall plane.

14. An electrical connector housing according to claim 13, wherein the common lid support member plane is disposed closer to the top wall plane relative to the bottom wall plane.

15. An electrical connector, comprising:

a terminal assembly including a terminal mounting block and at least one terminal mounted therein;

a housing body extending along and about a longitudinal axis defining a longitudinal direction, a lateral axis defining a lateral direction and a transverse axis defining a transverse direction, the longitudinal axis, the lateral axis and the transverse axis perpendicularly intersecting one another at a point of intersection to form a Cartesian coordinate system, the housing body surrounding the terminal assembly and being connected to the terminal mounting block, the housing body and the connected terminal mounting block defining a cavity with the at least one terminal projecting into the cavity from the terminal mounting block, the housing body having a top wall extending in the longitudinal direction and the lateral direction to define a top wall plane, a bottom wall extending in the longitudinal direction and the lateral direction to define a bottom wall plane extending parallel to the top wall plane and a pair of side walls extending in the longitudinal direction and the transverse direction, disposed apart from one another and interconnecting the top and bottom walls to form a front surface and a rear surface opposite the front surface, the cavity extending in the longitudinal direction into the housing body from the front surface and towards the rear surface; and a first rib member and a second rib member, respective ones of the first and second rib members being connected exteriorly of the housing body to respective ones of the pair of side walls and extending in the longitudinal direction, the first and second rib members being disposed between the top wall plane and the bottom wall plane, wherein each one of the first and second rib members includes a rib element and an eyelet element integrally connected to the rib element, wherein each rib element commences at a commencement position either at the front surface or set back from the front surface, extends towards the rear surface and terminates at the eyelet element, wherein the eyelet element of one of the first and second rib members is disposed adjacent to and set back from the rear surface and wherein the eyelet element of a remaining one of the first and second eyelet elements is disposed adjacent to and set back from the front surface.

16. An electrical connector according to claim 15, wherein each one of the rib elements is a bar having a rectangular shape as viewed in front elevation.

17. An electrical connector according to claim 15, wherein each one of the eyelet elements has a U-shaped eyelet portion and a box-shaped eyelet portion integrally connected to the U-shaped eyelet portion, respective ones of the box-shaped eyelet portions being connected to respective ones of the pair of side walls.

18. An electrical connector according to claim 17, wherein each one of the eyelet elements has an eyelet element thickness as viewed along the transverse direction and each one of the rib elements has a rib element thickness as viewed along the transverse direction.

19. An electrical connector according to claim 18, wherein the eyelet element thickness and rib element thickness are either equal to each other or the eyelet element thickness is larger than the rib element thickness.

20. An electrical connector according to claim 15, wherein each one of the eyelet elements has an eyelet hole extending in the transverse direction therethrough.

21. An electrical connector according to claim 15, wherein the remaining one of the first and second rib members disposed adjacent to and set back from the front surface has a first portion rib element and a second portion rib element with the eyelet element disposed between and integrally connected to the first portion rib element and the second portion rib element.

22. An electrical connector according to claim 21, wherein the first portion rib element is disposed adjacent the front surface and the second portion rib element is disposed adjacent the rear surface, the first portion rib element being shorter than the second portion rib element.

23. An electrical connector according to claim 15, wherein each one of the first and second rib members has a flat bottom rib member surface disposed in a common rib member plane, the common rib member plane extending between and parallel to the top wall plane and the bottom wall plane.

24. An electrical connector according to claim 23, wherein the common rib member plane is disposed closer to the bottom wall plane relative to the top wall plane.

25. An electrical connector according to claim 15, further comprising a pair of lid support members disposed exteriorly of the housing body, respective ones of the pair of lid support members connected to respective ones of the pair of side walls in a manner to extend in the longitudinal direction and to project in the lateral direction away from respective ones of the pair the side walls.

26. An electrical connector according to 25, wherein respective ones of the pair of lid support members extend from and between the front surface and the rear surface.

27. An electrical connector according to claim 26, wherein each one of the pair of lid support members has a flat bottom lid support member surface disposed in a common lid support member plane, the common lid support member plane extending between and parallel to the top wall plane and the bottom wall plane.

28. An electrical connector according to claim 27, wherein the common lid support member plane is disposed closer to the top wall plane relative to the bottom wall plane.

29. An electrical connector according to claim 15, wherein the housing body and the terminal assembly are connected together as an integral construction.

* * * * *